US008541707B2

(12) United States Patent
Bigand

(10) Patent No.: US 8,541,707 B2
(45) Date of Patent: Sep. 24, 2013

(54) KEYPAD WITH LONG KEY TRAVEL AND IMPROVED TOUCH FEELING

(75) Inventor: Jean-Louis Bigand, Vendôme (FR)

(73) Assignee: Thales, Neuilly sur Seine (FR)

( * ) Notice: Subject to any disclaimer, the term of this patent is extended or adjusted under 35 U.S.C. 154(b) by 252 days.

(21) Appl. No.: 13/126,425

(22) PCT Filed: Sep. 23, 2009

(86) PCT No.: PCT/EP2009/062301

§ 371 (c)(1),
(2), (4) Date: May 31, 2011

(87) PCT Pub. No.: WO2010/049219

PCT Pub. Date: May 6, 2010

(65) Prior Publication Data

US 2011/0214974 A1 Sep. 8, 2011

(30) Foreign Application Priority Data

Oct. 28, 2008 (FR) ..... 08 05986

(51) Int. Cl.
*H01H 13/70* (2006.01)

(52) U.S. Cl.
USPC ..... 200/345

(58) Field of Classification Search
USPC ..... 200/345, 341, 5 A, 5 B, 5 R, 16 B, 200/402, 406, 468, 511–517, 520–522, 276, 200/276.1, 329
See application file for complete search history.

(56) References Cited

U.S. PATENT DOCUMENTS

| | | | | |
|---|---|---|---|---|
| 4,207,448 | A | 6/1980 | Furusawa et al. | |
| 4,755,645 | A * | 7/1988 | Naoki et al. | 200/276.1 |
| 4,831,223 | A * | 5/1989 | Wako | 200/517 |
| 4,927,990 | A * | 5/1990 | Aoki et al. | 200/517 |
| 5,389,757 | A | 2/1995 | Souliere | |
| 6,664,491 | B2 * | 12/2003 | Yanai et al. | 200/516 |
| 6,765,164 | B2 * | 7/2004 | Lee et al. | 200/345 |

FOREIGN PATENT DOCUMENTS

| | | | |
|---|---|---|---|
| EP | 0392973 | A1 | 10/1990 |
| EP | 0446088 | A1 | 9/1991 |
| JP | 1-264125 | A | 10/1989 |
| WO | 82/01100 | A1 | 4/1982 |

* cited by examiner

*Primary Examiner* — Edwin A. Leon
*Assistant Examiner* — Anthony R. Jimenez
(74) *Attorney, Agent, or Firm* — Baker & Hostetler LLP

(57) ABSTRACT

A keypad includes at least one push-button switch and a key to operate the switch along a translational axis. The geometric dispersions of the keypad are accounted for, to the lengthening of the travel of the key and to the enhancement of the tactile sensation when the key is pressed to operate the switch. The keypad includes a plunger, interposed between the key and the switch, of which a stiffness along the translational axis increases continuously with an increase in the compression of the plunger. A slight stiffness at the beginning of compression allows a long travel of the key, while a greater stiffness at the end of compression gives a good tactile sensation with an assured contact even when there are off-center pressures on the key.

19 Claims, 5 Drawing Sheets

KEYPAD WITH LONG KEY TRAVEL AND IMPROVED TOUCH FEELING

CROSS-REFERENCE TO RELATED APPLICATIONS

This application is a National Stage of International patent application PCT/EP2009/062301, filed on Sep. 23, 2009, which claims priority to foreign French patent application No. FR 08 05986, filed on Oct. 28, 2008, the disclosures of which are incorporated by reference in their entirety.

FIELD OF THE INVENTION

The invention relates to a keypad comprising at least one push-button switch and a key making it possible to operate the switch. It relates to taking account of the geometric dispersions of the keypad, to the lengthening of the travel of the key and to the enhancement of the tactile sensation when the key is pressed to operate the switch. The invention finds a particular, but not exclusive, utility in the instrument panel of an aircraft.

BACKGROUND OF THE INVENTION

When it is intended for the instrument panel of an aircraft, but also for other fields, a keypad must satisfy a certain number of requirements, in particular dimensional requirements. A first requirement is the tolerance relating to the key overshoot. The key overshoot is the difference in height between the top surface of the key and the fixed surface of the keypad. This tolerance is usually slim, of the order of two to three tenths of a millimeter. A second requirement relates to the travel of the key. This travel must usually be between seven and ten tenths of a millimeter depending on the application. A third requirement relates to the force to be applied to a key in order to actuate the switch. The force is for example five or six newtons with a tolerance of about one newton. A fourth requirement may also relate to satisfaction from operating the switch, in other words to the tactile sensation obtained when pressing a key. This sensation is notably associated with the resistance put up by the key when it is pushed and with the marked change in resistance observed when the switch passes from the open state to the closed state. This sensation is important in ensuring reliable feedback to the operator operating the switch.

The dimensional requirements may be all the more difficult to satisfy because the fixed portion of the keypad is often made of an assembly of parts. An assembly is for example necessary when the keypad is backlit. The keypad then comprises at least one front face, a printed circuit forming a base and a diffuser interposed between the front face and the printed circuit. The keypad may also comprise sealing elements between the fixed portion and the movable portion, that is to say the key or keys. The assembly of various parts of the keypad causes a geometric dispersion usually of the same order of magnitude as the travel of the key and as the tolerance concerning the key overshoot. For a keypad designed for an aircraft instrument panel, the geometric dispersion is ordinarily between six and ten tenths of a millimeter depending on the tolerance of the parts and the care applied to assembling the keypad.

Moreover, push-button switches have an insufficient travel to achieve the minimum travel required for the key. In this instance, the travel of a dome switch is rarely greater than three tenths of a millimeter. Even for a switch incorporating elastomers, the travel is usually less than seven tenths of a millimeter. Consequently, it is not usually possible to produce a rigid connection between the key and the movable portion of the switch.

SUMMARY OF THE INVENTION

Several solutions have been envisaged by the applicant to ensure both the tolerance of key overshoot and the minimum travel of the key. FIG. 1 illustrates a first exemplary embodiment of a keypad in a view in section of a portion of the keypad along a plane passing through a key. The keypad comprises a printed circuit 10 forming a base, a front face 11 securely attached to the printed circuit 10 by means of a plate 12 and a push-button switch 13 mounted on the printed circuit 10. The push-button switch 13 is for example a switch of the "dome" or "blister" type that is to say in which the switching takes place by deflection of a conductive elastic blister dome against two conductors to be connected. This type of switch is known in Anglo-Saxon literature as a dome switch. The front face 11 and the plate 12 comprise an opening 14 allowing a key 15 to move in translation along an axis X and to operate the switch 13. According to this first exemplary embodiment, the overshoot tolerance 16 of the key 15 is ensured by pressing the key 15 against the front face 11. This pressing can be carried out by a spring 17 prestressed between the key 15 and the assembly consisting of the printed circuit 10, the front face 11 and the plate 12. In particular, the spring 17 can press on an internal collar 18 made on the plate 12. The travel of the key 15 can be limited on the side opposite to the switch 13 by a shoulder 20 made on the key 15 pressing against the bottom of a counterbore 19 made on the front face 11. The minimum travel of the key can for its part be ensured by the existence of a clearance 21 between the bottom end 151 of the key 15 and the switch 13.

This first exemplary embodiment makes it possible to absorb great dispersions in the assembly and to greatly lengthen the travel of the key 15. However, it has several drawbacks. FIG. 2 shows in graph form the change in a force applied to the key 15 according to a travel of this key 15 for the first exemplary embodiment. For the rest of the description, it is considered that the key 15 moves along the axis X, the origin O of the travel being determined by the rest position, that is to say when the key is not pushed and it is pressed against the bottom of the counterbore 19. It is also considered that the force is applied to the key 15 along the axis X in the direction of the switch 13. The change in force depending on the travel is represented by a curve 24. A first portion 241 of this curve 24 is shown by a straight line with a positive gradient. This portion 241 corresponds to the pressure of the spring 17 alone, the gradient of the straight line corresponding to the stiffness of the spring 17. Beyond a point of travel $C_1$, the lower end 151 of the key 15 makes contact with the movable portion of the switch 13. The stiffness of the switch 13 is then added to the stiffness of the spring 17. On the graph, the total of the stiffness of the spring 17 and of the switch 13 is reflected by a second portion 242 of the curve 24 shown by a straight line with a steeper gradient and therefore by a discontinuity in the variation of the force for the point of travel $C_1$. This discontinuity is a drawback because it takes the form of a hard point that can make an operator operating the key 15 think that the switch 13 has reached the end of travel and has therefore established an electrical contact. A third portion 243 of the curve 24 can be shown by a convex curve portion. This portion 243 corresponds to the beginning of the deflection of the switch 13 and comprises the point of maximum force $F_{max}$ that can be applied to the key 15 before the switch 13 makes an electrical contact. This maximum force $F_{max}$ occurs for a point of travel $C_2$. A fourth portion 244 of the curve 24 can be represented by a concave curve portion, the force falling sharply after the point of travel $C_2$ has been passed. This portion 244 corresponds to the continued deflection of the switch 13. It comprises the point of minimum force $F_{min}$ that can be applied to the key 15 to keep the switch 13 closed. This minimum force $F_{min}$ corresponds to a point of travel $C_3$. Beyond the point of travel $C_3$, the key 15 can still be pushed in for a short distance until the spring 17 is completely compressed for a point of travel $C_4$ corresponding to the mechanical travel $C_m$ of the key 15. The key 15 is then at the end of travel. The exemplary embodiment as illustrated in FIG. 1 therefore exhibits the drawback of introducing a discontinuity of force into the travel of the key 15.

FIG. 3 illustrates a second example envisaged by the applicant for the production of a keypad in a sectional view similar to FIG. 1. According to this second exemplary embodiment, the tolerance of overshoot 16 for the key 15 is also ensured by pressing the key 15 against the front face 11. On the other hand, the pressing is carried out by a deformable element, called a plunger 31, prestressed against the lower end 151 of the key 15 and the switch 13. The plunger 31 consists for example of a cylinder of revolution.

FIG. 4 represents in graph form similar to FIG. 2 the change in force applied to the key 15 depending on its travel for the second exemplary embodiment. A first curve 41 shows the change in force for a plunger 31 of slight stiffness and a second curve 42 shows the change in force for a plunger 31 with greater stiffness. In this example, the points of travel $C_2$ and $C_4$ defined above are considered to be identical for both curves 41 and 42. The point of travel $C_3$ is marked $C_{31}$ for the curve 41 and $C_{32}$ for the curve 42. The second exemplary embodiment makes it possible to remove the clearance 21 between the lower end 151 of the key 15 and the switch 13. Because of this there is no marked change in stiffness when the key 15 is actuated between the origin O and the point of travel $C_2$. Moreover, this second exemplary embodiment makes it possible to a certain extent to lengthen the travel of the switch 15 and to absorb the geometric dispersions of the assembly. The lengthening of the travel of the key 15 and the capacity to absorb the dispersions are promoted by a slight stiffness of the plunger 31, the latter then deforming easily between the key 15 and the switch 13. However, the plunger 31 with a slight stiffness has a tactile sensation which is not as good. The tactile sensation associated with the transition of the switch 13 from the open position to the closed position can be represented by the ratio R between the difference in force $\Delta F$ between the minimum force $F_{min}$ and maximum force $F_{max}$ and the difference in travel $\Delta C$ between the points of travel $C_2$ and $C_3$. The ratio R can be defined by the following relation:

$$R = \frac{F\max - F\min}{C_3 - C_2} = \frac{\Delta F}{\Delta C}$$

The greater this ratio R, in other words the greater the average gradient in absolute value of the curve 24 between the travels $C_2$ and $C_3$, the better the tactile sensation. Specifically, an operator actuating the key 15 feels the transition of the switch 13 more strongly when the force that he applies to the key 15 falls sharply for a slight movement of this key 15. In FIG. 4, the fact that the tactile sensation of a plunger of great stiffness is better than that of a plunger of slight stiffness can be clearly seen. Specifically, for one and the same difference in force $\Delta F$, the difference in travel $\Delta C_1$ between the points of travel $C_2$ and $C_{31}$ is greater than the difference in travel $\Delta C_2$ between the points of travel $C_2$ and $C_{32}$. This phenomenon is associated with a more rapid delivery of the energy stored in a plunger 31 of great stiffness than in a plunger 31 of slight stiffness. Moreover, when there are off-center pressures on the key 15, that is to say when there are pressures along an axis forming an angle with the axis X or along an axis parallel to the axis X but on one edge of the key 15, the switch 13 might not be actuated with a plunger 31 of slight stiffness. Specifically, the plunger 31 might deform by bending and store energy without being able to deliver it along the axis X in order to activate the switch 13. In conclusion, for this second exemplary embodiment, a compromise has to be found on the stiffness of the plunger 31 in order, on the one hand, to have a sufficient capacity of elongation and of absorption of the dispersions and, on the other hand, to ensure the activation of the switch 13 when there are off-center pressures on the key 15. In practice, this second exemplary embodiment is mainly suitable for a slight elongation of the travel of the switch 13 and requires an adaptation of the length of each plunger 31 to the geometric dispersions of the keypad at each key 15. The individual adjustment of lengths of plungers 31 is clearly costly and makes this embodiment inappropriate for the mass production of keypads.

One object of the invention is notably to alleviate the aforementioned drawbacks by proposing a keypad of simple design in which the keys 15 have a long travel and a good tactile sensation. Accordingly, the subject of the invention is a keypad comprising a push-button switch, a key making it possible to operate the push-button switch along a translational axis and a plunger interposed between the key and the switch. According to the invention, a stiffness of the plunger along the translational axis increases continuously with an increase in compression of the plunger.

A notable advantage of the invention is that it makes it possible to combine the advantages of a keypad comprising a plunger of slight stiffness with those of a keypad comprising a plunger of great stiffness for a low production cost.

BRIEF DESCRIPTION OF THE DRAWINGS

The invention will be better understood and other advantages will appear on reading the detailed description of embodiments given as examples, which description is made with respect to appended drawings which represent.

DETAILED DESCRIPTION

Figure 1:
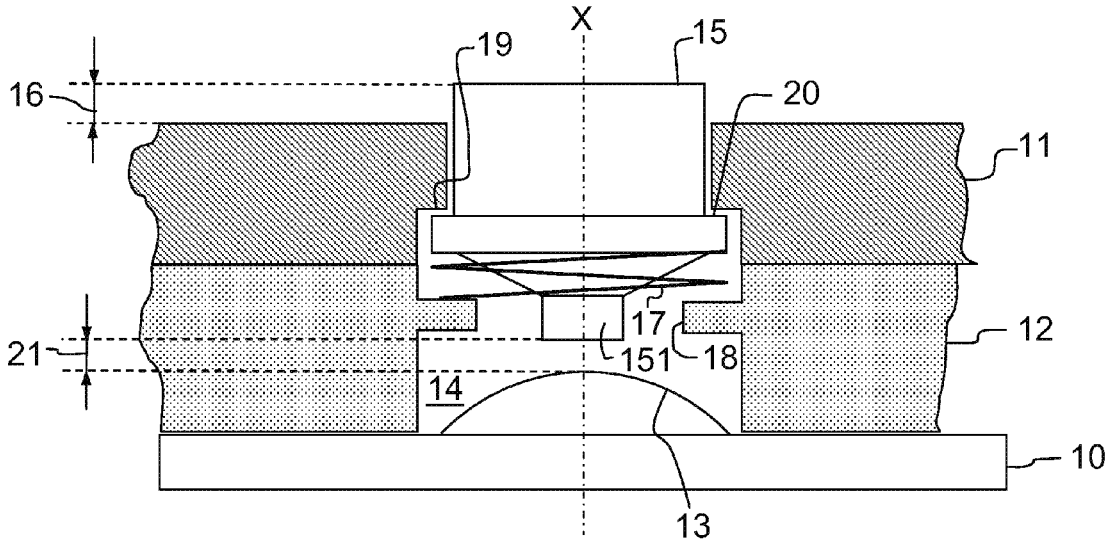
FIG. 1, already described, a first exemplary embodiment of a keypad in a sectional view along a plane passing through a key of the keypad, FIG. 2, already described, the change in a force applied to the key of the keypad of FIG. 1 depending on the travel of this key, FIG. 3, already described, a second exemplary embodiment of a keypad in a view similar to that of FIG. 1, FIG. 4, already described, the change in force applied to a key of the keypad of FIG. 3 depending on its travel, FIG. 5, an exemplary embodiment of a keypad according to the invention in a view similar to that of FIGS. 1 and 3, FIG. 6, the change in force applied to a key of the keypad of FIG. 5 depending on its travel for a first embodiment of a keypad according to the invention, FIG. 7, the change in force applied to a key of the keypad of FIG. 5 depending on its travel for a second embodiment of a keypad according to the invention, FIGS. 8A, 8B and 8C, examples of a configuration of a keypad according to the second embodiment, FIG. 9, the change in force applied to a key of a keypad of FIG. 8A, 8B or 8C depending on its travel.
Figure 3:
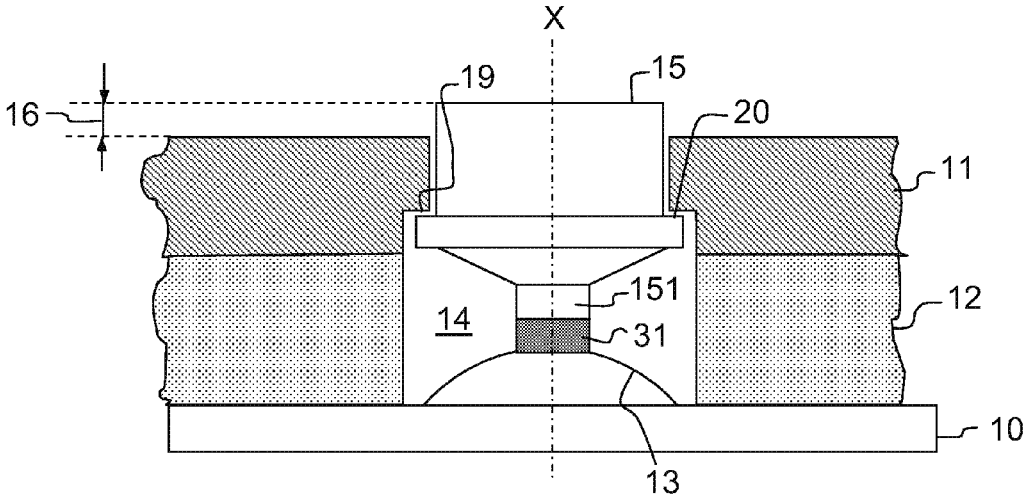
Figure 5:
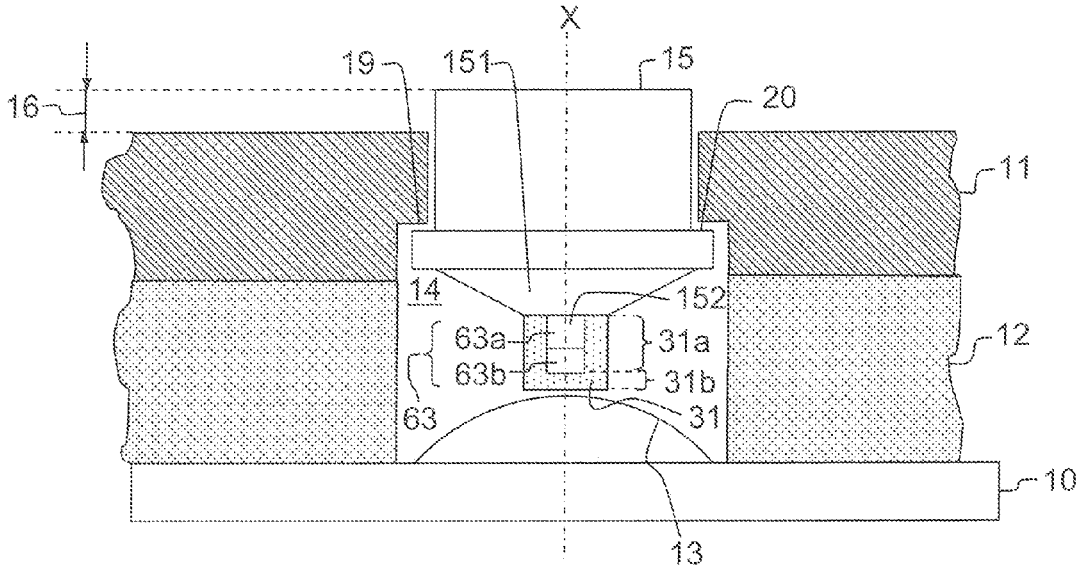

FIG. 5 represents an exemplary embodiment of a keypad according to the invention in a sectional view similar to FIGS. 1 and 3. The keypad according to the invention is similar to the second exemplary embodiment, the main difference relating to the plunger 31. According to the invention, the stiffness of the plunger 31 along the axis X increases continuously when there is pressure on the key 15 before the actuating of the switch 13. In other words, the stiffness of the plunger 31 increases with an increase in its compression for a travel of the key 15 preceding the actuation of the switch 13.

According to a first embodiment, the stiffness of the plunger 31 increases continuously until it reaches a given compression point, the stiffness remaining constant beyond this compression point. This particular embodiment makes it possible to obtain a still better tactile sensation. The plunger 31 is for example made in a single piece of uniform material. The plunger 31 can therefore be made by molding very cheaply. The material is advantageously an elastomer such as silicone. In order to make it possible to obtain both a good tactile sensation and a great capacity of deformation of the plunger 31, and therefore of elongation of the travel of the switch 13 and of absorption of the geometric dispersions of the keypad, the hardness of the elastomer may be between 60 and 80 Shore A. It is for example 70 Shore A. The present description relates to a keypad comprising a single key 15. Naturally, the keypad may have several keys 15 and, in particular, a plunger 31 as described above for each key 15 of the keypad.

Figure 2:
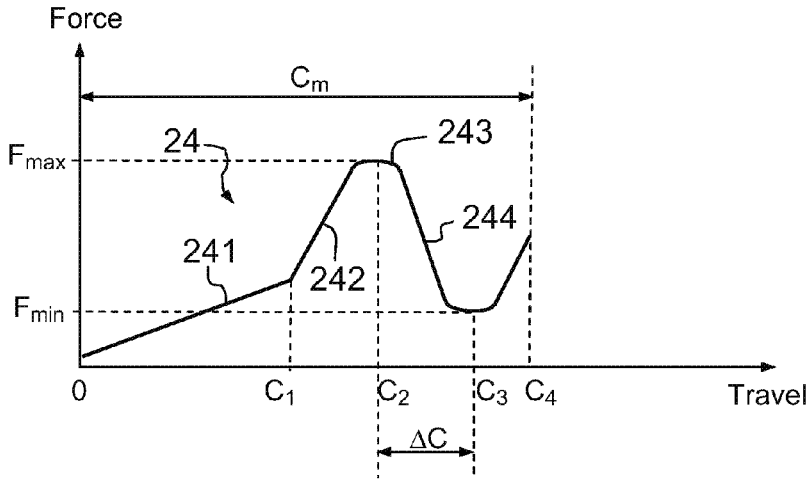
Figure 4:
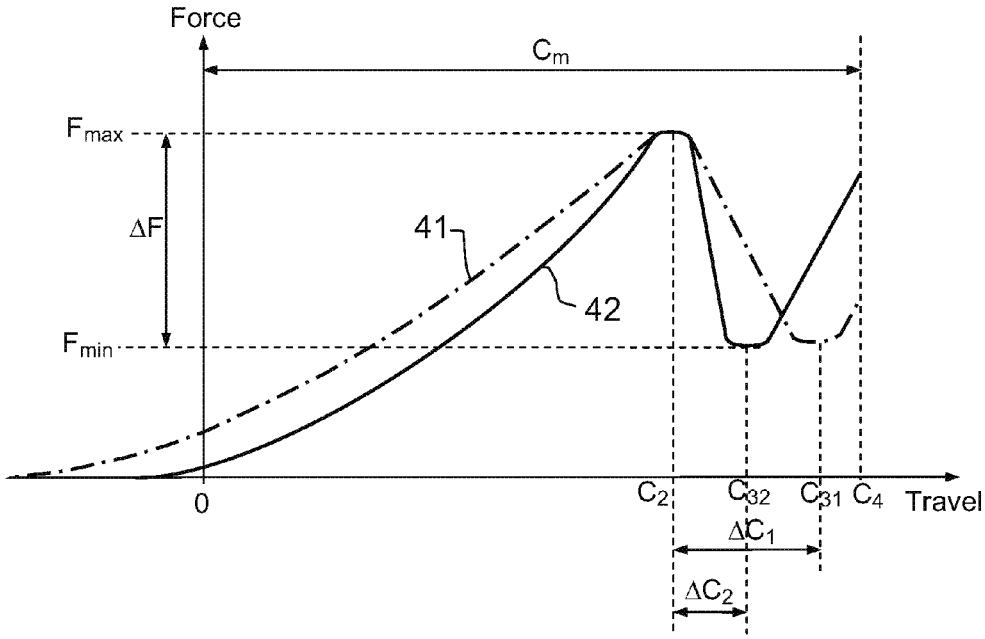
Figure 6:
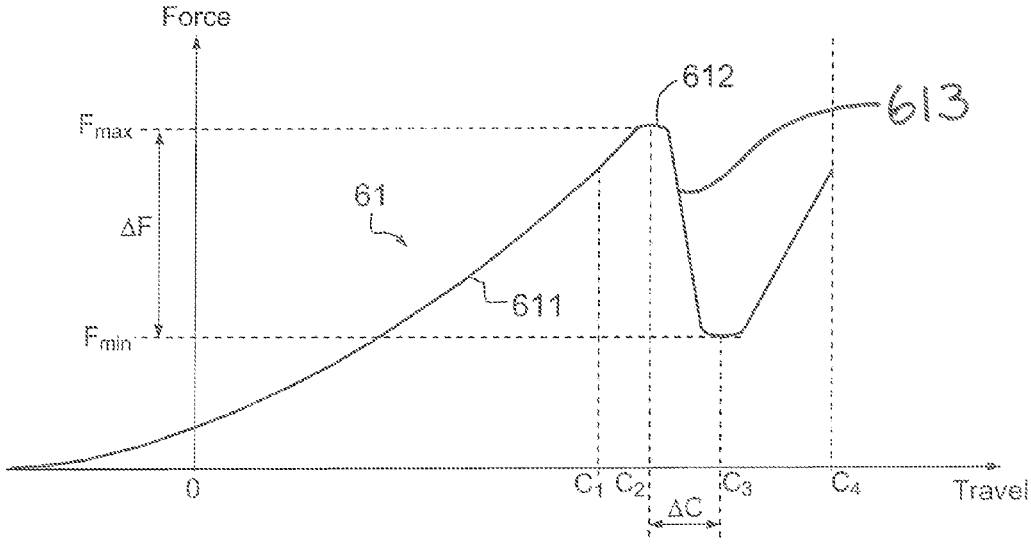

FIG. 6 represents, in the form of a graph similar to the graphs of FIGS. 2 and 4, the change in the force applied to a key 15 of the keypad of FIG. 5 depending on the travel of this key 15 for the first embodiment of the invention. The change in force is shown by a curve 61. On this curve 61, it is possible to see that the plunger 31 is prestressed between the lower end 151 of the key 15 and the switch 13, the ordinate at the origin $F_0$ of the curve 61 being greater than zero. It is also possible to see that, on a first portion 611 of the curve 61, the stiffness of the key 15, represented by the gradient of the curve 61, increases progressively without discontinuity. On a second portion 612 of the curve 61, the reaction of the switch 13 becomes dominant over that of the plunger 31, the deflection of the switch 13 being initiated. This portion 612 of the curve 61 comprises the point of maximum force $F_{max}$ that can be applied to the key 15 before the switch 13 makes an electrical contact. This maximum force $F_{max}$ occurs at the point of travel $C_2$. On a third portion 613 of the curve 61, the force drops suddenly with the continuation of the deflection of the switch 13 until it reaches the minimum force $F_{rain}$ at the point of travel $C_3$. The force can then increase until it reaches the mechanical abutment of the key 15 at the point of travel $C_4$. The difference in travel $\Delta C$ between the points of travel $C_2$ and $C_3$ is of the same order of magnitude as the difference in travel $\Delta C_2$ observed for a plunger 31 of great stiffness. This phenomenon is explained by the fact that, just before the deflection of the switch 13, the plunger 31 is greatly compressed and is therefore characterized by a great stiffness. Consequently, the ratio R is great and the key 15 has a good tactile sensation.

According to a second embodiment, the plunger 31 has two distinct constant stiffnesses. In this instance, it has a slight stiffness $k_1$ at the beginning of compression and a greater stiffness $k_2$ at the end of compression. The slight stiffness $k_1$ makes it possible, through its great capacity for deformation, to absorb the geometric dispersions and to lengthen the travel of the key, and the great stiffness $k_2$ makes it possible to obtain a good tactile sensation.

A plunger 31 of which the stiffness increases with its compression can notably be made by an appropriate shape of the plunger 31. In this instance, the plunger 31 may comprise a recess 63, as shown in FIG. 5. This recess 63 makes it possible to define an upper portion 31*a* of the plunger 31 and a lower portion 31*b* of the plunger 31, the upper portion 31*a* corresponding to the portion of the plunger 31 that comprises the recess. The plunger 31 and/or the recess 63 may revolve around the axis X. According to a particular embodiment, shown in FIG. 5, the plunger 31 and/or the recess 63 are cylindrical.

According to a particularly advantageous embodiment, the recess 63 is used in order to fix the plunger 31 to the key 15. The key 15 then comprises a lug 152 the shape of which complements that of an upper portion 63*a* of the recess 63. The plunger 31 is fitted onto the lug 152 and is held there by elastic deformation. The relative heights of the lug 152 and of the recess 63 along the axis X are determined so as to leave an empty space 63*b* between the lug 152 and the bottom of the recess 63. The height of this empty space 63*b* is for example between five and fifteen tenths of a millimeter for a total height of the plunger 31 for example of between three and four millimeters. The height of the empty space 63*b* is determined by a computation of the average geometric dispersion of the assembly of the keypad and the knowledge of the necessary travel of the key 15. It is the presence of the empty space 63 that makes it possible to modify the stiffness of the plunger 31 with its compression.

Figure 7:
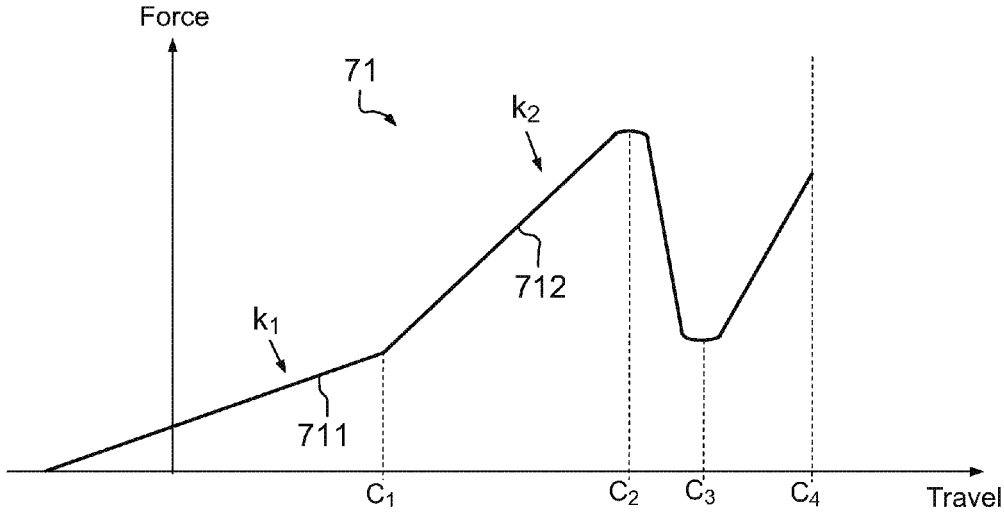

FIG. 7 represents, in the form of a graph similar to the graphs of FIGS. 2, 4 and 6, the change in the force applied to a key of the keypad of FIG. 5 depending on its travel for the second embodiment of the invention. The change in the force is represented by a curve 71. At the origin of the travel of the key 15, the upper portion 31*a* of the plunger 31 supports the majority of the deformation of the plunger 31. This upper portion 31*a* has specifically an initial stiffness $k_1$ that is less than a stiffness $k_2$ of the lower portion 31*b*. Beyond a certain point of travel $C_1$, corresponding to the height of the empty space 63*b*, the lug 152 comes into contact with the bottom of the recess 63. The additional deformation of the plunger 31 is then essentially supported by the lower portion 31*b* which has the constant stiffness $k_2$. In FIG. 7, this phenomenon is reflected by a first segment 711 with gradient $k_1$ between the origin and the point of travel $C_1$ and by a second segment 712 of gradient $k_2$ between the point of travel $C_1$ and the point of travel $C_2$ for which the maximum force is produced before the switch 13 makes an electrical contact. In FIG. 7, the transition between the stiffness $k_1$ and the stiffness $k_2$ is sudden. However, it is possible to obtain a smoother transition.

Figures 8A, 8B, 8C:
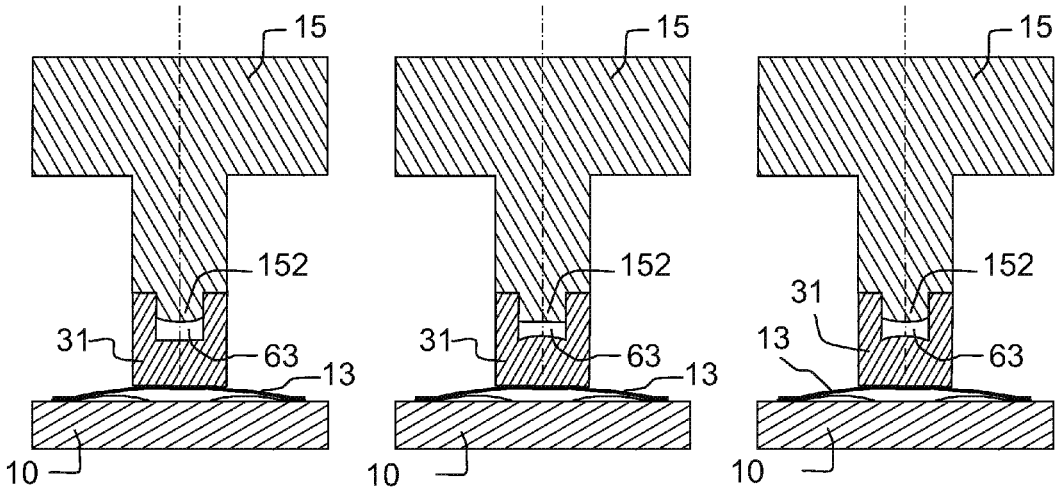

FIGS. 8A, 8B and 8C illustrate examples of key and plunger configuration according to the second embodiment and in which the transition between the two stiffnesses $k_1$ and $k_2$ is smoothed. According to a first example of configuration, shown in FIG. 8A, the lug 152 of the key 15 has a convex shape coming into contact with the bottom of the recess 63. In this figure, the bottom of the recess 63 is flat. According to a second example of configuration, shown in FIG. 8B, it is the bottom of the recess 63 of the plunger 31 that has a convex shape, the portion of the lug 152 coming into contact with the bottom of the recess 63 having a flat shape. According to a third example of configuration, shown in FIG. 8C, both the lug 152 and the bottom of the recess 63 have a convex shape. In FIGS. 8A, 8B, 8C, it has been considered that the smoothing of the transition between the two stiffnesses $k_1$ and $k_2$ was provided by a convex shape. Naturally, any shape providing a progressive increase of the contact surface between the key 15 and the bottom of the recess 63 can be produced within the context of the invention.

Figure 9:
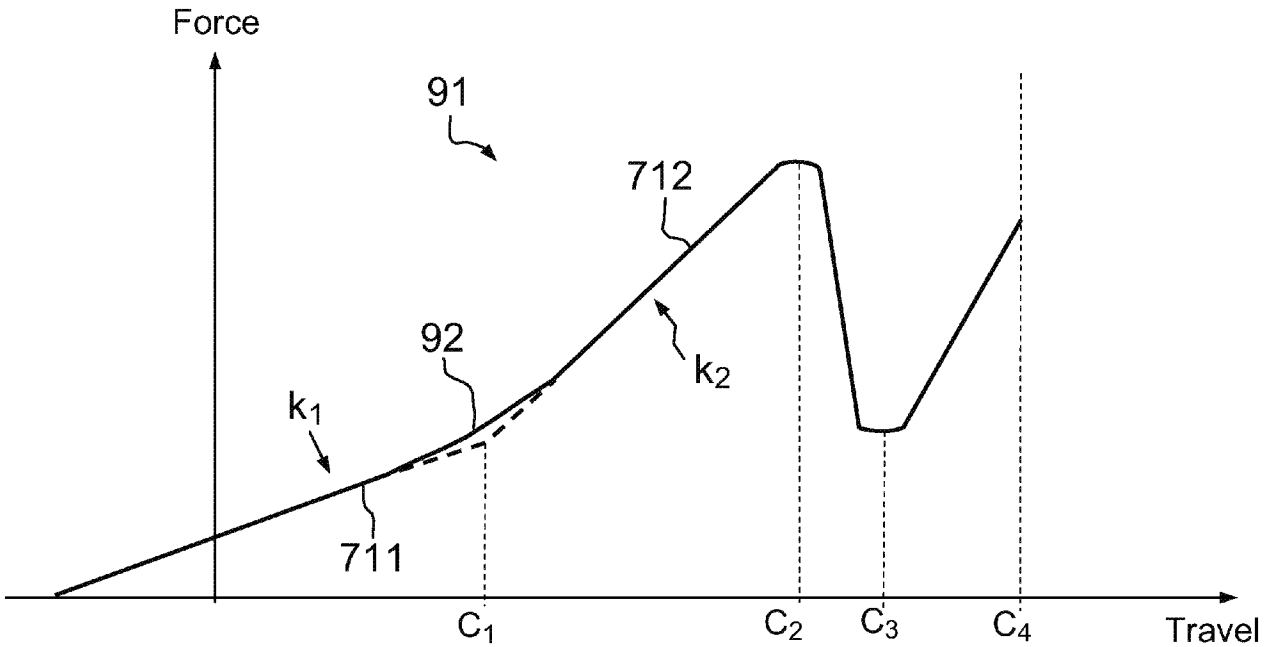

FIG. 9 shows, in the form of a graph similar to the graphs of FIGS. 2, 4, 6 and 7, the change in the force applied to a key of the keypad as a function of its travel according to the examples of configuration of FIGS. 8A, 8B, 8C. The change in force is represented by a curve 91. Relative to the curve 71, the curve 91 differs essentially in that it comprises a portion of curve 92 linking the first segment 711 of gradient $k_1$ to the second segment 712 of gradient $k_2$ in the vicinity of the point of travel $C_1$.

The plunger 31 according to the invention may be deformed elastically to a considerable degree in its upper portion 31*a*. It therefore allows a long travel of key 15 and a great capacity of absorption of the dispersions of the keypad. In this instance, it is not necessary to adapt the length of the various plungers 31 to the geometric dispersions of the keypad at each key 15. The plungers 31 may have standard dimensions. The plunger 31 also has a great stiffness in its lower portion 31*b*. It thus provides a good tactile sensation.

The invention claimed is:

1. A keypad comprising:

a push-button switch;

a key for operating the push-button switch along a translational axis; and a plunger interposed between the key and the push-button switch, wherein a stiffness of the plunger along the translational axis increases with a travel of the key along the translational axis before the push-button switch is actuated, the plunger being in contact with the switch, wherein the plunger comprises a recess, a portion of the plunger comprising the recess defining an upper portion of the plunger which has a first stiffness, and a remaining portion of the plunger defining a lower portion of the plunger which has a second stiffness, the second stiffness being greater than the first stiffness, wherein the lower portion of the plunger is interposed between the upper portion of the plunger and the push-button switch, wherein at the beginning of the travel of the key toward the push-button switch, the plunger is essentially deformed at the upper portion of the plunger, the upper portion of the plunger being fitted onto a lug of the key, the lug being distant from a bottom of the recess along the translational axis at the beginning of the travel of the key toward the push-button switch, the bottom of the recess separating the upper portion of the plunger and the lower portion of the plunger, the recess being opened toward the key and closed toward the push-button switch by the bottom of the recess, and wherein beyond a point of travel for which the lug comes into contact with the bottom of the recess, the plunger is essentially deformed at the lower portion of the plunger, the stiffness of the plunger therefore increasing continuously in line with the first stiffness and then the second stiffness before the switch is actuated.

2. The keypad of claim 1, wherein the first stiffness and second stiffness are substantially constant.

3. The keypad of claim 2, further comprising:

means for ensuring a progressive transition between the first stiffness and the second stiffness during the travel of the key.

4. The keypad of claim 1, wherein the plunger is made of a single piece of uniform material.

5. The keypad of claim 1, wherein the plunger is made of an elastomeric material.

6. The keypad of claim 1, wherein the plunger is cylindrical.

7. The keypad of claim 1, wherein the recess is cylindrical.

8. The keypad of claim 1, wherein the lug has a shape to match a shape of an upper portion of the recess, the lug being inserted into said upper portion of the recess.

9. The keypad of claim 1, wherein the lug or the bottom of the recess has a shape ensuring a progressive increase of a contact surface between the key and the bottom of the recess, the lug or the bottom of the recess forming the means for ensuring a progressive transition between the first stiffness and the second stiffness during the travel of the key.

10. The keypad of claim 1, further comprising:

a front face secured to the push-button switch and comprising an opening traversed by the key; and means for limiting a travel of the key on the side opposite to the push-button switch, the plunger being prestressed between the key and the push-button switch.

11. The keypad of claim 10, wherein the means for limiting the travel of the key comprises:

a shoulder on the key, and a counterbore made on the front face.

12. The keypad of claim 1, wherein a hardness of the material of the plunger is between 60 and 80 Shore A.

13. The keypad of claim 1, wherein the plunger is in contact with the switch during an entire travel of the key along the translational axis.

14. The keypad of claim 1, wherein the lower portion of the plunger is solid.

15. The keypad of claim 1, wherein the upper portion of the plunger includes a tubular portion delimiting the recess.

16. The keypad of claim 1, wherein the bottom of the recess is flat.

17. The keypad of claim 1, wherein the bottom of the recess has a convex shape.

18. The keypad of claim 1, wherein the lug has a convex shape that comes into contact with the bottom of the recess at a point of travel of the key for which the lug comes into contact with the bottom of the recess.

19. The keypad of claim 1, wherein the plunger is compressed during travel of the key before the lug comes into contact with the bottom of the recess and after the lug comes into contact with the bottom of the recess.

* * * * *